United States Patent [19]

Suzuki et al.

[11] 4,379,482

[45] Apr. 12, 1983

[54] PREVENTION OF CRACKING OF CONTINUOUSLY CAST STEEL SLABS CONTAINING BORON

[75] Inventors: Hiroo Suzuki, Yokohama; Koichi Yamamoto, Kawasaki; Yasuhide Ohno; Kou Miyamura, both of Kitakyushu, all of Japan

[73] Assignee: Nippon Steel Corporation, Tokyo, Japan

[21] Appl. No.: 212,335

[22] Filed: Dec. 2, 1980

[30] Foreign Application Priority Data

Dec. 6, 1979 [JP] Japan ..... 54-157457

[51] Int. Cl.[3] ..... B22D 11/16

[52] U.S. Cl. ..... 164/485; 164/122

[58] Field of Search ..... 164/485–487, 164/459, 122, 122.1, 122.2, 126, 128; 148/3

[56] References Cited

FOREIGN PATENT DOCUMENTS

| | | | |
|---|---|---|---|
| 2402343 | 8/1974 | Fed. Rep. of Germany . | |
| 2449812 | 5/1975 | Fed. Rep. of Germany . | |
| 2461127 | 7/1975 | Fed. Rep. of Germany . | |
| 639643 | 12/1978 | U.S.S.R. ..... | 164/122 |

*Primary Examiner*—Gus T. Hampilos
*Assistant Examiner*—K. Y. Lin
*Attorney, Agent, or Firm*—Cushman, Darby & Cushman

[57] ABSTRACT

Production of boron-containing steel slabs free from surface defects by continuous casting, particularly prevention of the slab surface crackings by cooling the slab with a specific cooling rate through the temperature range from the melting point to 900° C. so as to prevent boron-containing compounds such as BN from precipitating along the austenite grain boundary. Great advantage over the conventional art is that boron-containing molten steels which could not be continuously cast can be successfully continuously cast into slabs free from surface defects.

5 Claims, 6 Drawing Figures

(x50)

(x100)

L CROSS SECTION (x50)

PREVENTION OF CRACKING OF CONTINUOUSLY CAST STEEL SLABS CONTAINING BORON

BACKGROUND OF THE INVENTION

1. Field of the Invention

The present invention relates to the prevention of crackings in continuously cast carbon or alloy steel slabs containing boron.

2. Description of the Prior Art

In recent years, in the fields of low carbon steels used for automobile car bodies and for production of galvanized sheets, and medium carbon steels used for production of high tension steel plates for machine structural use, and further in the fields of high carbon steels, etc. for production of bar rods or seamless pipe, more and more boron containing steels have been used.

Boron, when added in a very small amount in steels, markedly improves the quality (particularly strength-ductility balance) of thin steel sheet products, or in the cases of high tension steel plates or steel bars, considerably improves the martensite hardenability, so that it is possible to reduce the carbon content in the steels and to improve the weldability of the steels. Further, boron can substitute precious alloying elements, such as nickel and chromium, in wide applications, so that it is possible to lower the alloying cost. Therefore, the addition of boron in steels is very advantageous for improvements of the steel quality and reduction of the production cost.

As well known, these grades of boron-containing steels are conventionally processed into ingots by the ingot-making process and the resultant ingots are subjected to hot rolling and heat treatment processes into final products.

In the ingot-making process, the molten steel in the ingot mold solidifies over a long period of time so that a satisfactory surface quality of the ingot can be assured and the surface defects of the ingot as discussed hereinafter have caused no substantial problem.

In recent years, for saving the energy, and for improving the productivity and lowering the production cost by simplifying the production processes, more and more boron-containing steels have been processed into steel slabs by the continuous casting process in substitution of the ingot-making process. However, when boron-containing steel slabs are produced by an ordinary continuous casting machine, many defects are caused not only in the internal quality, but also in the surface quality. This problem has been prohibiting a commercial production of boron-containing steel slabs by continuous casting.

To illustrate examples, when about 10 to 30 ppm boron is added to low-carbon Al-killed molten steels or Al-Si killed molten steels which are presently cast by continuous casting, the resultant continuously cast slabs have often a remarkably deteriorated surface quality. And once such surface defects have been caused on boron-containing steel slabs, hot or cold stage scarfing either by gas or mechanical surface grinding must be performed on the partial or whole surface of the slabs to remove the defects, and this scarfing not only requires much labour and cost, but also markedly lowers the production yield of the slabs, thus killing the advantages inherent to the continuous casting process.

SUMMARY OF THE INVENTION

The present invention has been completed on the basis of results of extensive studies conducted by the present inventors on production conditions, thermal histories of continuously cast steel slabs and so on for the purpose of realizing a commercial production of boron-containing steel slabs free from surface defects by the continuous casting process.

One of the objects of the present invention is to provide a method for producing steel slabs having a satisfactory surface quality substantially free from the surface defects by continuous casting, and more particularly a method for preventing surface cracking of continuously cast boron-containing steel slabs.

BRIEF DESCRIPTION OF THE DRAWINGS

FIG. 1(*c*) is an optical microscope photograph (x100) showing the surface portion of the steel slab produced according to the present invention.

DETAILED DESCRIPTION OF THE INVENTION

The present invention will be described in great detail with reference being made to the attached drawings.

Figure 2:
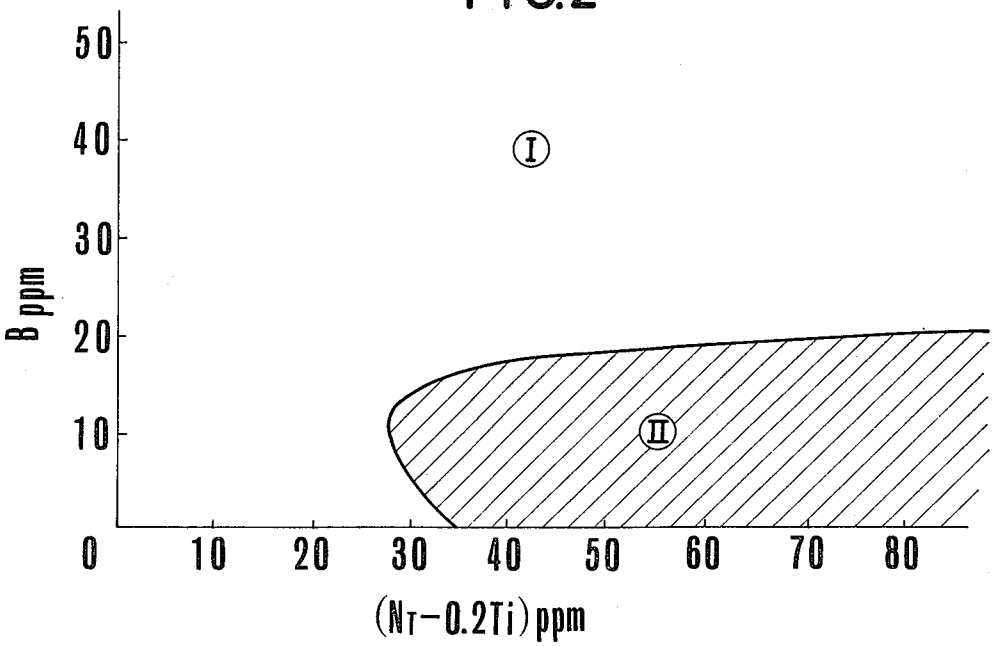
FIG. 2 is a graph showing the embrittlement of the steel in relation with the ($N_T$-0.2Ti) and boron contents.

For achieving the object of the present invention, a molten steel containing boron and nitrogen in the range II indicated in FIG. 2 is continuously cast and during the continuous casting process, the steel is cooled from the melting point to 900° C. with an average cooling rate ranging from 0.01° to 1° C./sec. so as to restrict the precipitation of boron-containing compounds along the grain boundaries and cause the compounds to precipitate in the austenite grains. The particle size boron-containing precipitates along the grain boundaries can be maintained at at least 1$\mu$ or larger.

Figure 1:
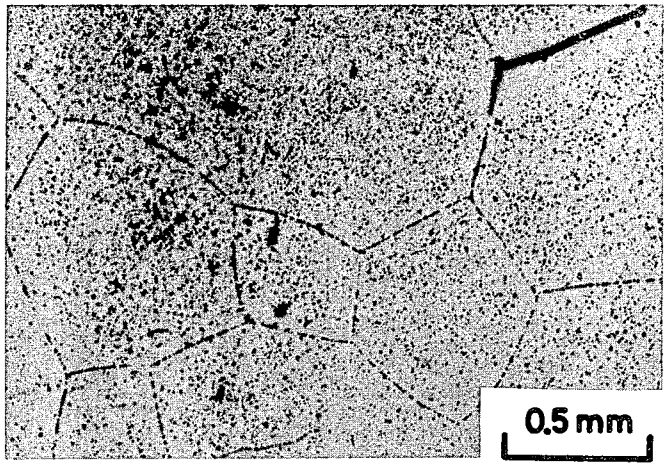
FIG. 1(*a*) and FIG. 1(*b*) are respectively an optical microscope photograph (x50) showing the distribution of boron-containing compounds and crackings in the surface portion of the steel slabs.
Figure 1:
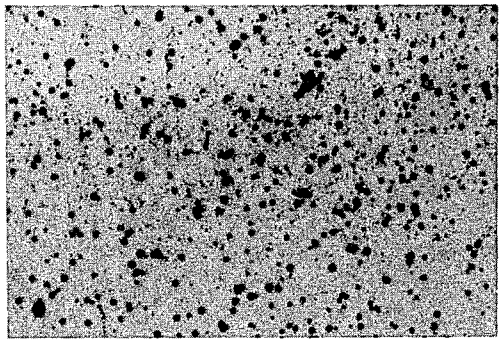
Figure 1:
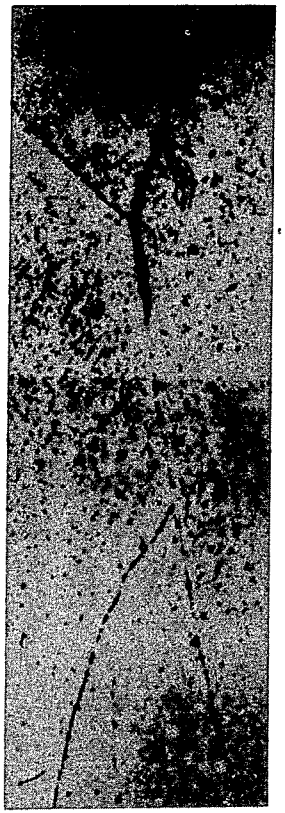

The surface cracking (particularly transverse facial cracking and corner cracking) of a boron-containing steel slab is attributed to the following facts. In the surface portion (20 mm or less deep) of the steel slab, boron-containing compounds, such as BN, $Fe_XBy$, $Fe_{23}(CB)_6$, are precipitated along the austenite grain boundaries in the temperature range of from 1000° to 600° C., and these precipitates facilitate the formation of the proeutectoid ferrite and also acts as nucleation sites of the cracking. Here, X and Y in the $Fe_XB_Y$ denotes moler fraction of Fe and B. Under such a condition, when tensile stress is imposed on the austenite grain boundaries, the grain boundary gliding and the intergranular voids are caused, finally leading to grain boundary fracture, which is resulted in surface cracking. FIG. 1(*a*) is an optical microscope photograph (x50) by the autography method ($\alpha$-ray fission track etching method), showing the distribution of the boron-containing compounds appearing in the surface of a continuously cast boron-containing steel slab and FIG.

1(*b*) is optical microscope photograph (x50) showing the surface quality of this steel slab when 2 mm surface ground. As clearly seen from FIG. 1, the surface cracking occurs along the austenite grain boundaries, and the surface cracking intimately corresponds to the intergranular precipitation of the boron-containing compounds. The particle size of these precipitates causing the surface cracking is about 0.1 to 0.7$\mu$.

Investigations have been made as to what effects the boron and nitrogen contents in the steel will have on the surface cracking of the slab in the continuous casting of a boron-containing steel by studying the cracking mechanism by a simulation method in a laboratory comparing to an actual production. Test pieces of round bar steel of 10 mm diameter were subjected to a tension test using a horizontal type high temperature tension test machine in a solidification-cooling stage (hereinafter will be called melted material) after the test piece was once melted, or in a cooling stage after the test piece was subjected to a solid solution treatment at high temperature.

As the results of studies for many years, it has been revealed that the embrittlement which occurs in the temperature range of from 1000° to 700° C. during a low-speed tension deformation (strain rate$\leqq 5\times10^{-2}$/-sec.) well represents the slab surface cracking, particularly the traverse facial cracking and the corner cracking.

FIG. 2 illustrates some results of evaluation of the sensitivity of boron-containing steels to the cracking by the above simulation experiments. For this evaluation, the test pieces were once heated to 1300° C. and then during the cooling at 20° C./sec. subjected to tension deformation with a strain rate of $5\times10^{-2}$/sec. The evaluation of the sensitivity to the cracking was done by the amplitude of the embrittlement temperature zone, $\Delta T$, in the temperature range of from 1000° to 700° C. More precisely, $\Delta T$ is defined as the embrittlement temperature range having a reduction of area (RA) less than 60% by a simulation experiment. In FIG. 2, the vertical axis represents the boron contents (ppm), and the horizontal axis represents the $N_T$-0.2Ti) contents (ppm), in which "$N_T$" represents the total content of nitrogen involved in each heat. "Ti" is mentioned as one of the elements which easily reacts with the nitrogen, and may be substituted by Zr and Hf which are also easily combined with the nitrogen. So, ($N_T$-0.2Ti) indicates the nitrogen content which has a chance to combine with boron. When the results are roughly classified on the basis of a parameter of the embrittlement temperature zone, $\Delta T$, of 60 degrees C., FIG. 2 may be divided into Zone I, in which surface embrittlement would be suppressed, and Zone II, in which the embrittlement zone, namely the sensitivity to the surface cracking is increased by the precipitation of BN, etc. along the austenite grain boundaries.

Thus, when both the boron content and the ($N_T$-0.2Ti) content are relatively low, no surface cracking takes place, thus suppressing the slab surface cracking, but on the other hand, when the boron content is 20 ppm or less and the ($N_T$-0.2Ti) content is 30 ppm or larger, the slab belongs to the embrittlement zone, Zone II. However, if the boron content exceeds 20 ppm, the grain boundary precipitation of the boron-containing compounds is suppressed in spite of increased ($N_T$-0.2Ti) contents so that no surface cracking is caused.

Therefore, so far as the molten steel has a chemical composition within Zone I in FIG. 2, the surface cracking makes no tangible problem even when an ordinary continuous casting process is applied, but when the molten steel composition falls in Zone II, the slab surface cracking is remarkable. Regarding the lower limit of the boron content, about 3 ppm or larger boron is effective for the desired improvement of the material quality by the boron addition, but even if the boron content is less than 3 ppm, the slab cracking is more likely to occur due to the adverse effect of nitrogen if the ($N_T$-0.2Ti) content is within Zone II in FIG. 2. Meanwhile, it has been confirmed that the evaluation results shown in FIG. 2 well correspond to the cracking evaluation results obtained by an actual production.

The gist of the present invention lies in that for the continuous casting of molten steels having a chemical composition falling in Zone II in FIG. 2, the cooling rate from the melting point to 900° C. is restricted so as to suppress the precipitation of the boron-containing compounds along the austenite grain boundaries, but intentionally induce the precipitation into the austenite grains, whereby the slab surface quality is improved.

Figure 3:
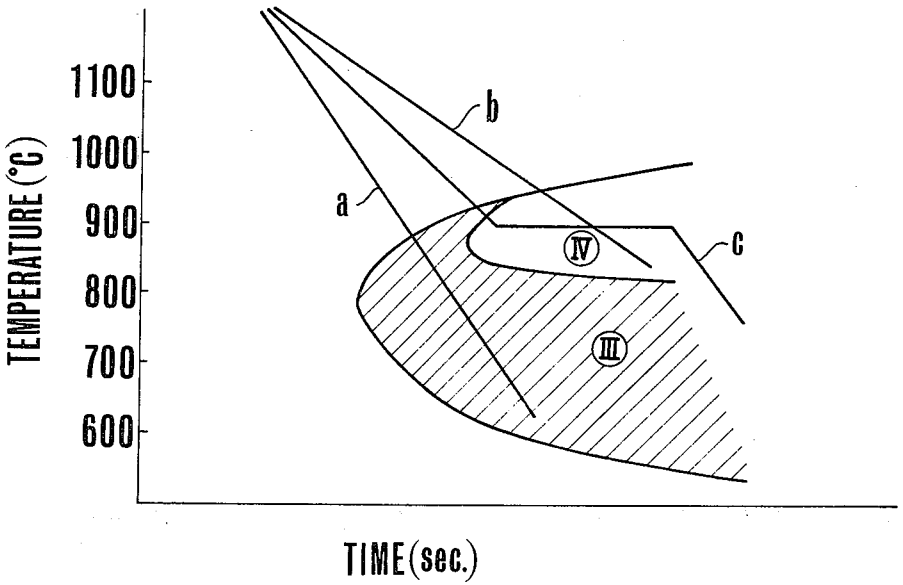
FIG. 3 is a graph showing the precipitation curve of BN, etc. during the cooling step.

In FIG. 3 in which the vertical axis represents the slab temperature, and the horizontal axis represents the period of time, the precipitation characteristics of the boron-containing compounds, such as BN, during the cooling step subsequent to the slab melting and solidification are schematically shown. In FIG. 3, Zone III represents a zone in which the precipitation of the boron-containing compounds, such as BN, along the austenite grain boundaries is remarkable, while Zone IV existing above a part of Zone III represents a zone in which the boron-containing compounds are caused to precipitate into the austenite grains. Contrary to the grain boundary precipitation, the precipitation in the austenite grains has been revealed to have no substantial effect on the slab surface cracking. Therefore, in the present invention, in the cooling step following the melting-solidification of the slab, the slab is subjected to a slow cooling so as to intentionally cause the boron-containing compounds, such as BN, to precipitate in the austenite grains.

It should be mentioned that FIG. 3 represents the precipitation curves of the boron-containing precipitates formulated on the basis of results of experiments using a steel composition containing:

| C | Si | Mn | B | N | V | |
|---|---|---|---|---|---|---|
| 0.12 | 0.25 | 1.5 | 0.0010 | 0.0040 | 0.05 | (% by weight) |

but these precipitation curves can be applied to all low-alloy steels as applicable to the present invention, except when the carbon content is extremely changed or the boron and nitrogen contents are extremely increased.

For promoting the precipitation of the boron-containing compounds in the austenite grains, it is necessary to limit the average cooling rate of the cooling from the melting point to 900° C. to the rate ranging from 0.01° to 1° C./sec. When the cooling rate exceeds 1° C./sec., the grain boundary precipitation is caused as shown by the cooling curve (a) in FIG. 3 so that it is impossible to suppress the surface cracking. On the other hand, when the cooling rate is so slow as below 1° C./sec., the precipitation in the austenite grains is caused as shown by the cooling curve (b). However, if the cooling rate is extremely slow as below 0.01° C./sec., the productivity of the commercial production is considerably hindered, although the slab surface cracking is effectively suppressed. Therefore, the lower cooling rate is set at 0.01° C./sec., in the present invention.

For achieving the maximum effect of the present invention and also a satisfactory commercial practicability, it is desirable that the cooling rate is maintained in a range of from 0.1° to 0.5° C./sec. In a commercial practice of the present invention, it is possible to prevent the slab surface cracking by maintaining the cooling rate in the slab surface portion within 20 mm in depth in the range of from 0.01° to 1° C./sec.

The essential point of the present invention is that, for the purpose of preventing the surface cracking of a boron-containing steel slab, the grain boundary precipitation of the boron-containing compounds in the slab surface portion is suppressed as much as possible, and even when the grain boundary precipitation takes place, it is advantageous that the particle of the precipitates is made coarse (thus reducing the number of the precipitates along the grain boundaries), so that the slab surface cracking is suppressed. For this purpose, various methods may be applied, such as by adoption of the cooling curve (c) in FIG. 3 and by maintaining the B-N balance in the slab surface portion within 20 mm in depth in the non-embrittlement Zone I in FIG. 2.

Needless to say, even in the case of a boron-containing steel having a chemical composition falling in the non-embrittlement Zone I in FIG. 2, a consistent continuous casting operation can be assured for the production of slabs free from the surface defects by promoting the precipitation within the austenite grains through the slow cooling according to the present invention.

As described above, the present invention has a great industrial value in that the slab surface cracking is effectively prevented in the continuous casting of a boron-containing steel so that boron-containing steels having chemical compositions which have hitherto been considered to be impossible to be applied to a commercial continuous casting process can be now applied to the continuous casting process. Also according to the present invention, as continuously cast steel slabs free from surface defects can be obtained, considerations conventionally required for preventing the slab cracking in the subsequent hot rolling step are reduced.

The present invention will be better understood from the following embodiments of the present invention.

EXAMPLE 1

A molten steel A having the chemical composition shown in Table 1 was prepared in a converter, degassed and subjected to continuous casting by a continuous casting machine having two strands with a mold size of 200 mm×1800 mm under the conditions:

| | |
|---|---|
| No. 1 strand | Drawing speed: 0.4 m/min. Forced cooling with a water ratio of 2.2 l/kg |
| No. 2 strand | Drawing speed: 0.6 m/min. Forced cooling with a water ratio of 0.8 l/kg |

The cooling curves in the wider surface of the slab were measured by using a spot-welded thermocouple, and it was revealed that the slab was rapidly cooled immediately after it got out of the mold, and in some cases the slab got down to a temperature of 900° C. or below, but immediately the slab restored the temperature, so that the average cooling rate immediately after the casting to 900° C. was 3° C./sec. in No. 1 strand and 0.08° C./sec. in No. 2 strand.

When the slab was surface-ground 1.5 mm by a grinder and subjected to a surface cracking examination, fine cracks of 1 to 2 mm in length were observed on the whole of the wider surface of the slab obtained by No. 1 strand (rapidly cooled at 3° C./sec.), while substantially no cracking was observed in the slab obtained by No. 2 strand (slowly cooled at 0.08° C./sec.).

The fine surface cracks in the No. 1 strand slab were cracks caused along the austenite grain boundaries, and according to the analyses of the distribution of the boron as revealed by the α-ray fission track etching, the precipitates were observed to be in the pattern of dots and lines along the grain boundaries as shown in FIGS. 1(*a*) and 1(*b*). While in the case of the slab slowly cooled in No. 2 strand so as to prevent the surface cracking, the boron was observed to precipitate uniformly distributed interior of the grains as shown in FIG. 1(*c*).

EXAMPLE 2

A molten steel B having the chemical composition as shown in Table 1 was continuously cast in a similar way as in Example 1. The surface cracking in the slab (rapidly cooled) by No. 1 strand was remarkable, while the slab by No. 2 strand (slowly cooled) was sound and free from the surface defect.

EXAMPLE 3

A molten steel C having the chemical composition shown in Table 1 was cast by a continuous casting machine of curved strand type having a mold size of 215 mm×2000 mm.

After a relatively rapid cooling at a casting speed of 1.0 m/min., the surface temperature of the slab was maintained constant between 1000° and 900° C. by providing a heat retaining cover on both lower and upper sides of the slabs and reducing the cooling water ratio to zero between the two pairs of rolls just before the bend correction by the pinch rolls. This is a simulation of the cooling curve (c) in FIG. 3. The results were that the grain boundary precipitation of the boron-containing compounds was suppressed and a sound slab free from surface crackings was obtained.

EXAMPLE 4

Figure 4:
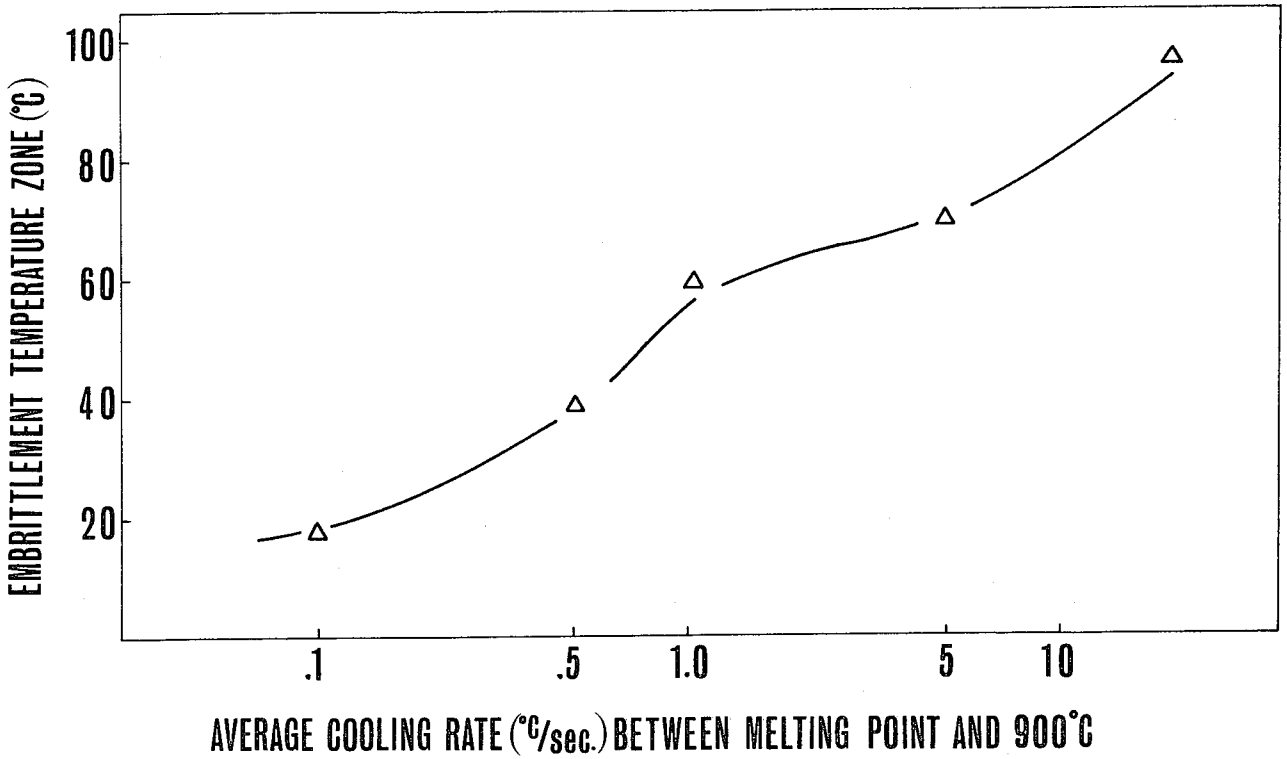
FIG. 4 is a graph showing the relation between the average cooling rate in the cooling from the melting point to 900° C. and the embrittlement temperature zone.

Test pieces of 10 mm in diameter were prepared from the slab (Steel C in Table 1) produced in Example 3 was investigated on the dependency of the crack sensitivity on the cooling rate by the laboratory simulation test as mentioned hereinbefore. The results are shown in FIG. 4. As clearly shown in FIG. 4, when the average cooling rate of the cooling from the melting point to 900° C. is 1.0° C./sec. or less, the embrittlement temperature zone, ΔT, covers 60° C. or less and the crack sensitivity is also lowered.

EXAMPLE 5

Molten steels D, E and F having respectively a chemical composition as shown in Table 1 were cast in a similar way as in Example 1. The results showed that the slabs obtained by No. 1 strand (rapid cooling) had remarkable surface crackings, while the slabs obtained by No. 2 strand (slow cooling) were sound and free from surface defects. In Table 1 the chemical composition is set forth in weight percent.

TABLE 1

| | C | Si | Mn | P | S | Al | Cr | V | Ti | N | B |
|---|---|---|---|---|---|---|---|---|---|---|---|
| Steel A | 0.12 | 0.4 | 1.1 | 0.02 | 0.003 | 0.06 | 0.14 | 0.05 | — | 0.006 | 0.0010 |
| Steel B | 0.15 | 0.2 | 1.3 | 0.015 | 0.005 | 0.03 | — | — | — | 0.007 | 0.0018 |
| Steel C | 0.13 | 0.45 | 1.0 | 0.017 | 0.003 | 0.05 | 0.15 | 0.03 | — | 0.006 | 0.0015 |
| Steel D | 0.14 | 0.25 | 1.2 | 0.016 | 0.015 | 0.07 | — | — | 0.02 | 0.009 | 0.0016 |
| Steel E | 0.17 | 0.2 | 1.6 | 0.014 | 0.007 | 0.065 | 0.2 | 0.04 | 0.012 | 0.008 | 0.0008 |
| Steel F | 0.41 | 0.3 | 1.1 | 0.015 | 0.017 | 0.05 | 0.3 | — | 0.015 | 0.007 | 0.0013 |

What is claimed is:

1. A method for preventing crackings of boron-containing steel slabs in continuous casting of molten steels containing nitrogen and boron in amounts falling within Zone II defined in FIG. 2, which comprises cooling the steels through a range of from the melting point to 900° C. with an average cooling rate ranging from 0.01° to 1° C./sec. to prevent precipitation of boron-containing compounds along austenite grain boundaries thereby promoting precipitation of the boron-containing compounds in the austenite grains.

2. A method according to claim 1, in which the average cooling rate is in a range of from 0.1° to 0.5° C./sec.

3. A method according to claim 1, in which the cooling rate ranging from 0.01° to 1° C./sec. is maintained in a slab surface portion of 20 mm or less in depth.

4. A method according to claim 1, which further comprises maintaining the particle size of boron-containing precipitates along the grain boundaries at least 1μ or larger.

5. A method according to claim 1, which further comprises maintaining the slab after the cooling at a constant temperature between 1000° and 900° C.

* * * * *